US007455214B2

(12) United States Patent
Miller et al.

(10) Patent No.: US 7,455,214 B2
(45) Date of Patent: Nov. 25, 2008

(54) ADJUSTABLE VOLUME STORAGE CONTAINER

(75) Inventors: Jared W. Miller, North Ridgeville, OH (US); Douglas W. Orischak, Hunker, PA (US)

(73) Assignee: Henkel Corporation, Rocky Hill, CT (US)

( * ) Notice: Subject to any disclaimer, the term of this patent is extended or adjusted under 35 U.S.C. 154(b) by 386 days.

(21) Appl. No.: 11/279,649

(22) Filed: Apr. 13, 2006

(65) Prior Publication Data

US 2007/0241172 A1 Oct. 18, 2007

(51) Int. Cl.
*B65D 5/32* (2006.01)
*B65D 5/355* (2006.01)

(52) U.S. Cl. ..... 229/101; 220/4.24; 220/6; 229/122.21

(58) Field of Classification Search ..... 229/101, 229/122.21, 198.2; 220/4.24, 4.25, 4.31, 220/6, 8
See application file for complete search history.

(56) References Cited

U.S. PATENT DOCUMENTS

| | | | | |
|---|---|---|---|---|
| 567,026 | A | 9/1896 | Goldberg | |
| 1,099,808 | A | 6/1914 | Martin | |
| 1,120,955 | A | 12/1914 | Martin | |
| 1,597,286 | A * | 8/1926 | Pinkerton | 229/101 |
| 1,930,896 | A * | 10/1933 | Hause et al. | 229/101 |
| 2,366,770 | A * | 1/1945 | Cordwell | 229/101 |
| 3,179,278 | A * | 4/1965 | Cohen | 220/8 |
| 3,508,699 | A * | 4/1970 | Graser | 229/101 |
| 3,521,810 | A * | 7/1970 | Boyer | 229/101 |
| 3,672,558 | A | 6/1972 | Johnson | |
| 4,601,407 | A | 7/1986 | Gillard | |
| 4,623,072 | A | 11/1986 | Lorenz | |
| 4,874,125 | A | 10/1989 | Bates | |
| 5,016,753 | A | 5/1991 | Henderson | |
| 5,129,019 | A * | 7/1992 | Robberg et al. | 385/42 |
| 5,150,646 | A * | 9/1992 | Lonczak | 229/122.21 |
| 5,192,019 | A | 3/1993 | Meehan | |
| 5,772,029 | A * | 6/1998 | Boccacci | 220/8 |
| 5,823,421 | A * | 10/1998 | Shilcock | 229/101 |
| 6,079,616 | A | 6/2000 | Chinks et al. | |
| 6,915,947 | B2 * | 7/2005 | Siurek et al. | 229/101 |

FOREIGN PATENT DOCUMENTS

EP 0326573 B1 7/1993

* cited by examiner

*Primary Examiner*—Gary E Elkins
(74) *Attorney, Agent, or Firm*—Fay Sharpe LLP

(57) ABSTRACT

The present application contemplates an adjustable volume storage container. The container is formed from two panels (10). The panels are made from a heavy duty paper board or corrugated cardboard, or the like, and are foldable. The panels (10) are prefabricated, each having a slot array (70) and two tabs (72, 74). The panels (10) are also cut to form sub-panels. The panels (10) are folded along lines (40) and (42) so that the tabs (72, 74) of one panel (10) can mate with the slot array (70) of the other panel (10). The particular slot selected determines the length of the container. Once the tabs (72, 74) are mated with the slot arrays (70), the bottom sub-panels (62, 64, 66) are folded under and fastened to form the container bottom. The container is filled, and then the upper sub-panels (50, 52, 54) are folded over and fastened creating the container top.

16 Claims, 5 Drawing Sheets

ADJUSTABLE VOLUME STORAGE CONTAINER

BACKGROUND

The present exemplary embodiment relates to storage and packing containers. It finds particular application in conjunction with adjustable size storage containers, and will be described with particular reference thereto. However, it is to be appreciated that the present exemplary embodiment is also amenable to other like applications.

Normally, packaging and shipping containers that are offered for sale are of a single size. If a small package is needed, then a small package is bought. If a large package is needed, then a large package is bought. In some applications, the size of container that is needed is not always known when it comes time to purchase it. In these cases it can be advantageous to purchase an adjustable volume storage container.

In the past, adjustable volume storage containers have often been cumbersome, require lots of space themselves, and have had additional moving parts, catches, latches, or clamps. It is often advantageous to buy a collapsible container that does not take up much space itself before it is needed, just to have on hand in case the need for a storage container arises. In this setting, the adjustable volume feature is particularly advantageous because one cannot know the size of container needed before the job even arises. The storage container of the present application overcomes the above-referenced problems and others.

BRIEF DESCRIPTION

In accordance with one aspect of the present exemplary embodiment, an adjustable volume storage container is provided. The container is constructed out of first and second panels, wherein at least one of the panels includes an array of slots, and at least one of the panels includes a plurality of tabs for engaging the slots. The particular slots engaged determine the volume of the storage container.

In accordance with another aspect of the present exemplary embodiment, a method of constructing a storage container is provided. The method starts with making incisions in two pre-fabricated panels, separating the panels into sections and defining vertical and horizontal fold lines. Next, the pre-fabricated panels are folded along the vertical lines, forming them into u-shaped configurations. Next, a size of the container is designated by mating tabs of a first panel with slots of a second panel. Then, a bottom of the container is formed by folding the panels along a lower horizontal fold line. The container bottom is fixed in place with an adhesive or fastener and finally, a top of the container is formed by folding the panels along an upper fold line.

In accordance with another aspect of the present exemplary embodiment, a method of constructing a storage container is provided. First, a size of box that is required for the given job is determined. Next, tabs from a first panel are aligned with correct slots of a second panel, and tabs from the second panel are aligned with correct slots of the first panel to achieve desired box size. Next, the tabs are positioned over the slots and slid down into place to interlock the panels. Next, the panels are folded, and the other sets of tabs and slots are interlocked. The bottom flaps are folded inward to create a bottom of the container and then secured in place. The top panels are folded inward creating a top of the container. Finally, the top flaps are secured in place.

DETAILED DESCRIPTION

Figure 1:
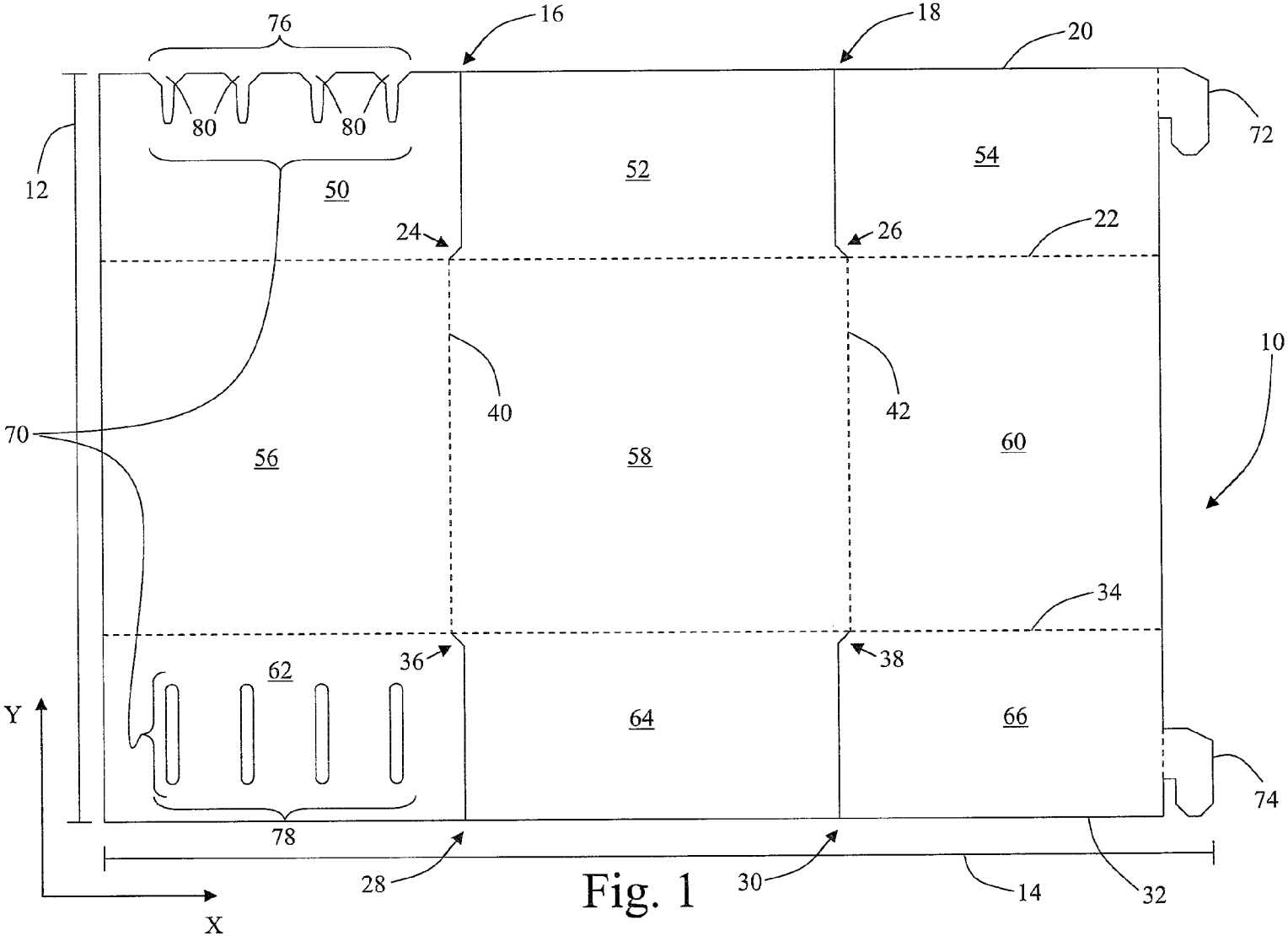
FIG. 1 is a two-dimensional illustration of an unfolded panel, in accordance with the present exemplary embodiment.

With reference to FIG. 1, an exemplary panel 10 for the construction of a storage container is shown. The panel 10 is preferably constructed of a heavy duty paper board, which is easily foldable yet resistant to tearing. The preferred total height 12 of the panel 10 is about 25 inches, while the preferred total width 14 of the panel is about 32 inches. These panel dimensions, of course, can be increased or decreased, but the preferred dimensions yield a container that is about 12 inches in width, about 13 inches in height, and a variable length of about 10-16 inches. In FIG. 1, solid lines represent lines along which the panel 10 is cut, while dotted lines represent lines along which the panel 10 is folded. The storage container of the present application is preferably constructed from two identical panels 10, although it will be made clear that identical panels 10 are not a necessity.

First, the incisions made on the panel 10 will be addressed. Incisions 16 and 18 extend from a top edge 20 of the panel 10 to a horizontal upper fold line 22 of the panel 10. The incisions 16, 18 run generally parallel to a vertical axis Y of the panel 10. The incisions 16, 18, while generally vertical and parallel, flare at their lowest points. The incision 16 includes a flare 24, and incision 18 includes a flare 26. The flares 24, 26 at the lowest points of the incisions 16, 18 facilitate accurate folding along the horizontal upper fold line 22.

Moving to the bottom of the panel 10, vertical incisions 28 and 30 similar to incisions 16, 18, extend from a bottom edge 32 of the panel 10 to a horizontal lower fold line 34. The incisions 28, 30 also have flares, 36 and 38 respectively. Like flares 24, 26, flares 36, 38 facilitate folding along lower fold line 34. In a similar fashion, flares 24 and 36 facilitate folding along a vertical left fold line 40, while flares 26 and 38 facilitate folding along a vertical right fold line 42. The upper and lower fold lines 26, 34 run parallel to a horizontal axis X of the panel 10, while the vertical fold lines 40, 42 run parallel to the vertical axis Y.

Having defined the fold lines and the incisions, it now becomes clear that the panel 10 has been sectioned into nine distinct sections, or sub-panels. These include, from the top-left, an upper slotted sub-panel 50 an upper end sub-panel 52, an upper tabbed sub-panel 54, a left front/back wall sub-panel 56, an end wall sub-panel 58, a right front/back wall sub-panel 60, a lower slotted sub-panel 62, a lower end sub-panel 64, and finally, a lower tabbed sub-panel 66. The slotted sub-panels 50, 62 and the tabbed sub-panels 54, 66 are so named because they include slots and tabs, respectively.

Each panel 10 contains an array of slots 70. In the preferred embodiment, each panel 10 also includes an upper tab 72 and a lower tab 74. The slot array 70 can be further divided into slot banks, including an upper slot bank 76 and a lower slot bank 78. The tabs 72, 74 are vertically aligned to mate with the slot array 70 of another panel 10. Likewise, the slot array 70 is aligned to mate with tabs 72, 74 of another panel 10. As can be seen in FIG. 1, the incisions 16, 18 extend to the upper horizontal fold line 22, which is below the upper slot bank 76, and the incisions 28, 30 extend to the lower horizontal fold line 34, which is above the lower slot bank 78. This ensures that no part of the slot array 70 will have to be folded.

Four slots are shown in each slot bank 76, 78. Naturally, this number could be more slots, or fewer slots as desired. In the preferred embodiment, a user constructing the container chooses the desired length of the container. Preferably, there are two inches between each slot's center in the slot banks 76, 78. Resultantly, in the preferred embodiment, the user can select 10, 12, 14, or 16 inches as the container's length. Naturally, it is to be understood that in addition to more or fewer slots, the distance between slots can also vary.

The lower slot bank 78 is contained entirely within the lower slotted sub-panel 62. Thus, the slots of the lower slot bank 78 are closed. In contrast, the slots of the upper slot bank 76 are located at the top edge 20 of the panel 10 within the upper slotted sub-panel 50. The top edge 20 of the panel 10 essentially bisects the upper slot bank 76 effectively making the height of slot bank 76 half that of slot bank 78. Furthermore, the top edge 20 of the panel 10 is redacted around its intersection with each slot of the slot bank 76, creating funnel-like apertures 80 at the top of each slot of slot bank 76. The apertures 80 make it easier to insert tab 72 of another panel 10 into a slot of the upper slot bank 76. The upper slot bank 76 and the lower slot bank 78 are vertically aligned, that is, each slot bank 76, 78 occupies the same space along the horizontal axis X of the panel. Having described the panel 10, discussion now turns to assembly of the container.

Figure 2:
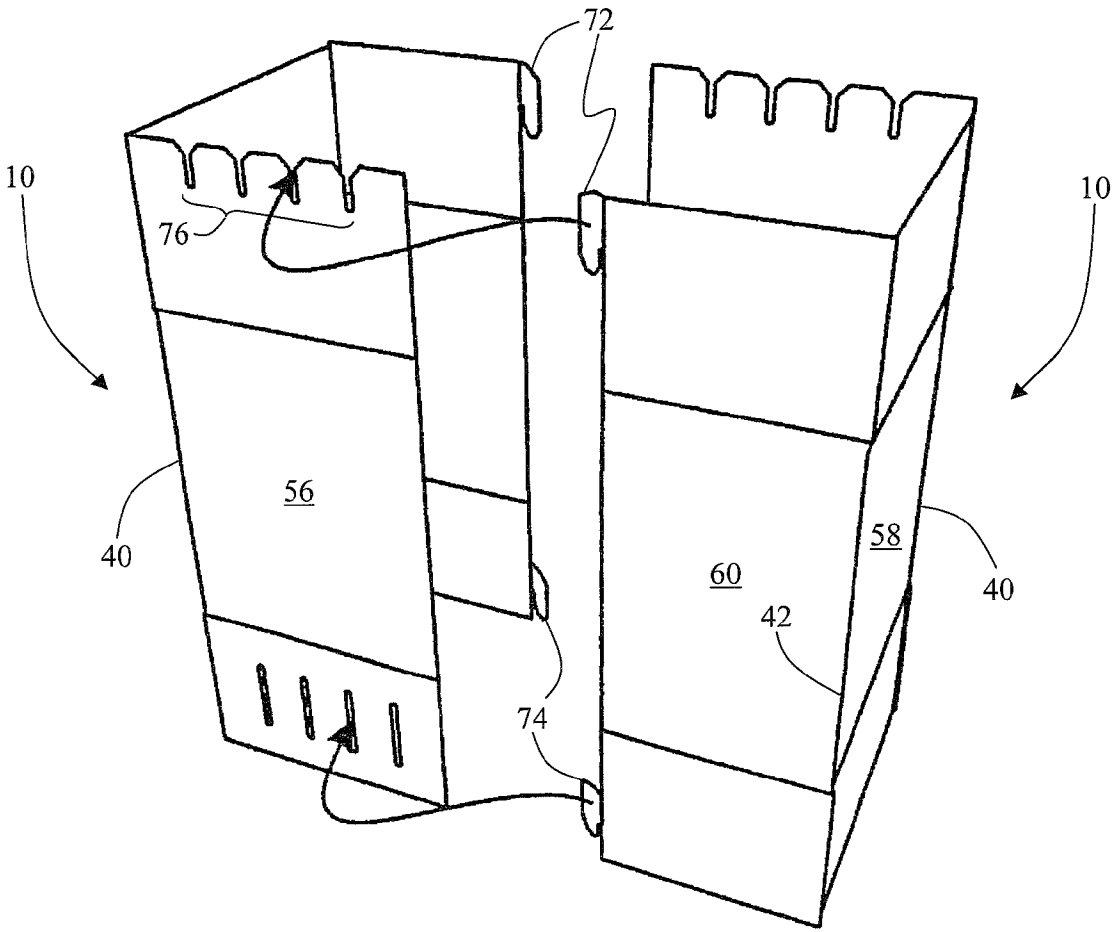
FIG. 2 is a perspective view of two panels of FIG. 1, folded and facing each other.

With reference to FIG. 2, two panels 10 are shown. FIG. 2 shows that the panels 10 have been folded along vertical fold lines 40 and 42. One panel 10 has been rotated 1800 to face the other panel 10. As indicated by the arrows, tab 72 is moved to engage upper slot bank 76 and tab 74 is moved to engage lower slot bank 78. Shown in FIG. 2, the slot being engaged is the third from the left, in both slot banks 76, 78. The tabs 72, 74 are inserted in the slots, and then lowered, locking the tabs 72, 74 into their respective slots. The tab insertion is then repeated for the other side using the same slots.

Figure 3:
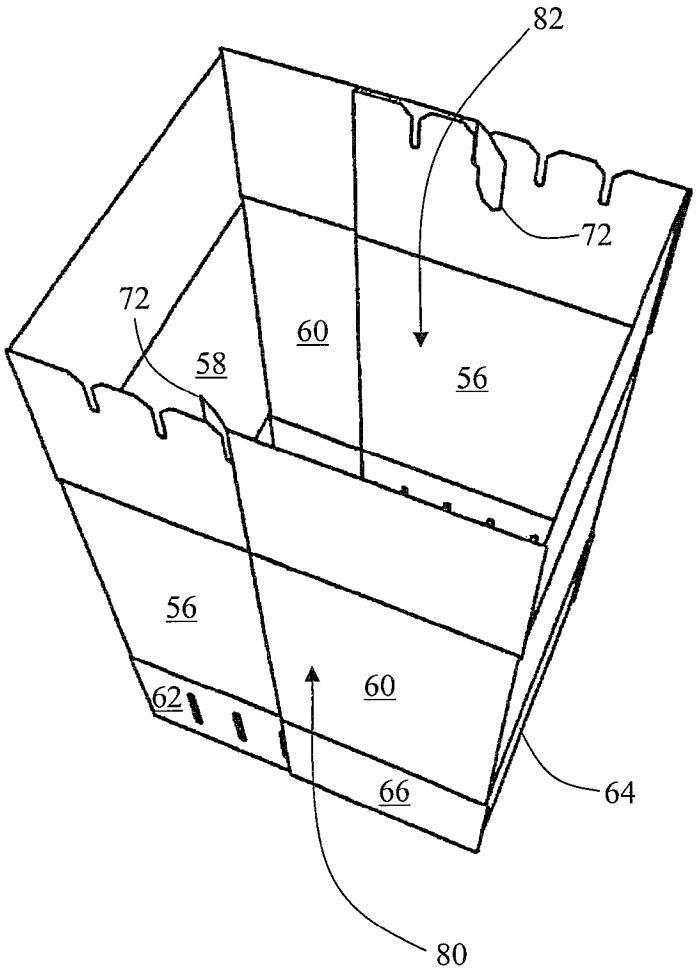
FIG. 3 is a perspective view of the two panels of FIG. 2 with the tabs and slots engaged.

Turning now to FIG. 3, a depiction of the container with the tabs 72, 74 engaged with the slots is shown. Once the tabs 72, 74 are engaged with the slots, the container begins to take shape. The left front/back wall sub-panel 56 from one panel 10 combines with the right front/back wall sub-panel 60 from the other panel 10 to form a front wall 80 of the container. The same goes for a back wall 82 of the container. The end wall sub-panels 58 form the end walls independently, without combining with any other sub-panels.

Figure 4:
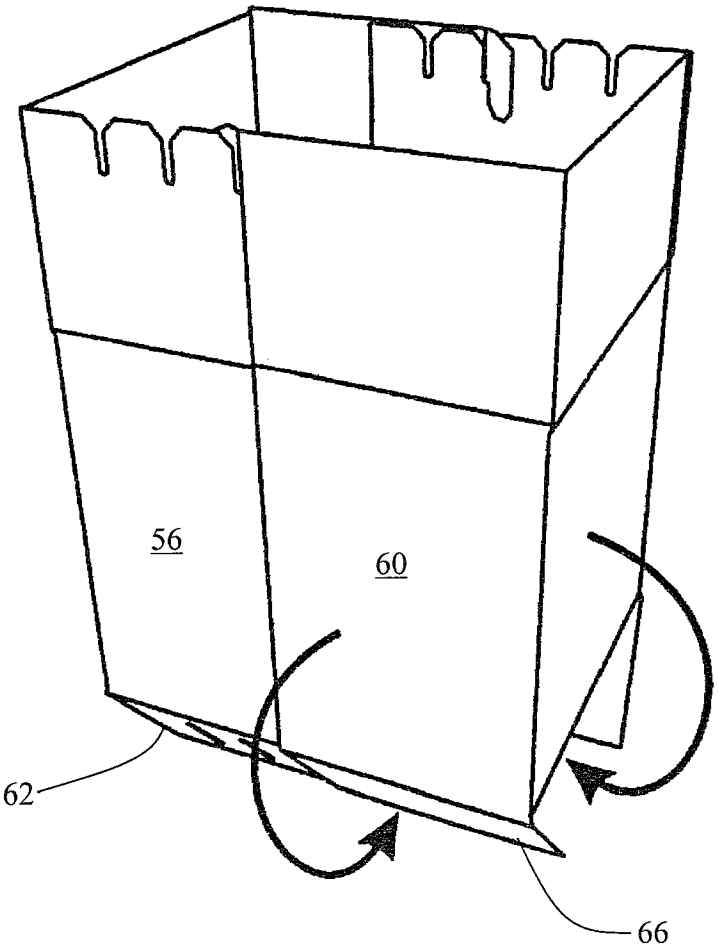
FIG. 4 depicts a process of folding lower sub-flaps under the container to create the container bottom; and, FIG. 5 depicts folding upper sub-flaps down to create the container top.

Turning now to FIG. 4, the bottom of the container is formed. The lower end sub-panels 64 from both panels 10 are folded underneath the container. Next, the lower slotted sub-panel 62 and the lower tabbed sub-panel 66 are folded underneath the container. Note that sub-panels 62 and 66 are still attached with the tab/slot engagement. Now that all of the lower sub panels 62, 64, 66 are folded underneath the box, they are adhered into place using packing tape or another suitable adhesive or fastening device. The container is now ready to be filled.

Figure 5:
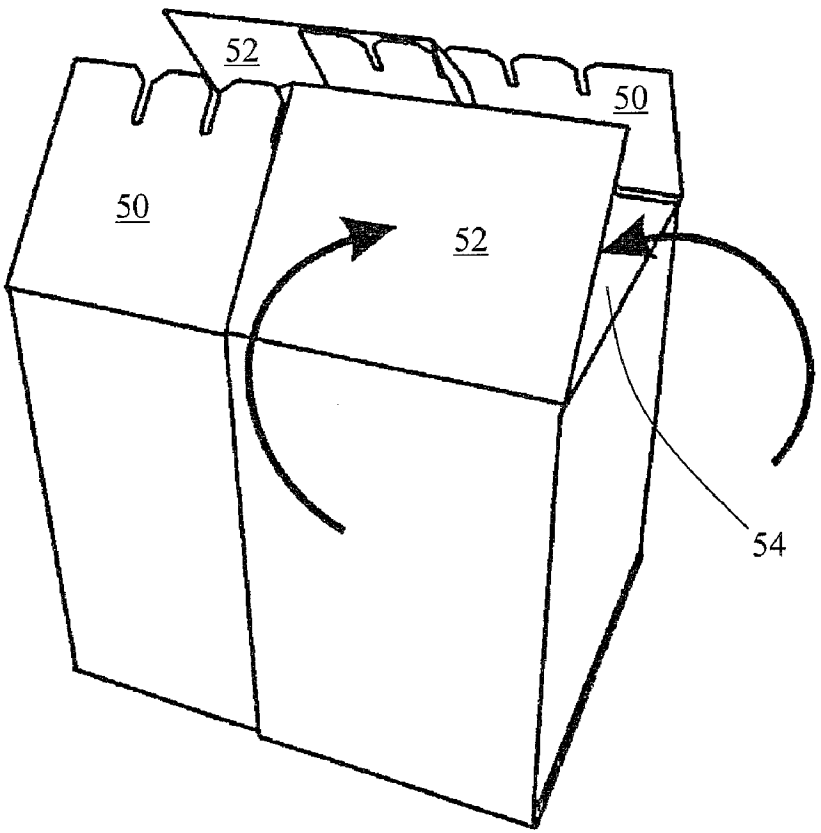

After the container is filled, with reference to FIG. 5, the upper sub-panels 50, 52, 54 are folded inward in similar fashion to the lower sub-panels 62, 64, 66. Once the container top is formed by the upper sub-panels 62, 64, 66 the container can be sealed in a similar fashion to the container bottom.

In an alternate embodiment of the present invention, the panels 10 are not identical. In one variation, one panel would have no tabs, only slots, and the other panel would have no slots, only tabs. This embodiment would require more than a single panel template, however.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

Having thus described the exemplary embodiment, the invention is claimed to be:

1. An adjustable volume storage container comprising:

a first panel having at least one edge, at least one interior portion, a first array of slots comprising a first upper slot bank and a first lower slot bank, and a plurality of tabs adapted to engage slots of a second array of slots;

a second panel having at least one edge, at least one interior portion, said second array of slots comprising a second upper slot bank and a second lower slot bank, and a plurality of tabs adapted to engage slots of said first array of slots, said second panel being substantially identical to said first panel;

whereby selection of the particular said slots engaged by said tabs determines the volume of the container;

said first lower slot bank comprising a plurality of slots, said first upper slot bank comprising a plurality of slots intersecting said first panel at least one edge whereby said plurality of first upper slots are open at said first panel edge;

said second lower slot bank comprising a plurality of slots, said second upper slot bank comprising a plurality of slots intersecting said second panel at least one edge whereby said plurality of second upper slots are open at said second panel edge.

2. The container as set forth in claim 1, wherein said first lower slot bank plurality of slots is in one of the at least one interior portion of said first panel and said second lower slot bank plurality of slots is in one of the at least one interior portion of said second panel.

3. The container as set forth in claim 1, wherein for each panel, said at least one edge includes an upper edge and the upper edge of each panel is redacted around the slot intersections with the upper edge creating funnel-like apertures.

4. The container as set forth in claim 1, wherein at least one said tab of the first panel is positioned to mate with one of the slots of the upper slot bank of the second panel, and at least one said tab of the first panel is positioned to mate with one of the slots of the lower slot bank of the second panel and at least one said tab of the second panel is positioned to mate with one of the slots of the upper slot bank of the first panel, and at least one said tab of the second panel is positioned to mate with one of the slots of the lower slot bank of the first panel.

5. The container as set forth in claim 4, wherein in each panel, the slots of the upper slot bank are vertically aligned with the slots of the lower slot bank.

6. The container as set forth in claim 1, wherein each of the first and second panels are vertically divided into one end wall and two front/back wall portions by divides, each of the panels being foldable along the divides.

7. The container as set forth in claim 6, wherein each of the panels are partially cut along the divides.

8. The container as set forth in claim 7, wherein the cuts along the divides extend from a lower edge of each of the panels to above the lower slot bank and from an upper edge of each of the panels to below an upper slot bank.

9. The container as set forth in claim 1, wherein each of the panels is separated with substantially vertical incisions, separating each of the panels into one end wall and two side wall portions.

10. The container as set forth in claim 9, wherein the incisions include small non-vertical portions to facilitate folding of the panels along pre-designated fold lines.

11. A method of constructing a container comprising:

making incisions, defining vertical and horizontal fold lines and providing tabs and slots in two panels separating the panels into sections and creating pre-fabricated panels;

folding the pre-fabricated panels along the vertical lines, forming each of the pre-fabricated panels into a u-shaped configuration;

designating a size of the container by mating tabs of a first of said pre-fabricated panels with designated slots selected from arrays of slots formed in a second of said pre-fabricated panels;

forming a bottom of the container by folding each of the pre-fabricated panels along a lower horizontal fold line;

fixing the container bottom in place with one of an adhesive and a fastener; and, forming a top of the container by folding each of the pre-fabricated panels along an upper fold line.

12. The method as set forth in claim 11, wherein the incisions include small non-vertical portions to facilitate folding of the pre-fabricated panels along the vertical and horizontal fold lines.

13. The method as set forth in claim 11, wherein each of the pre-fabricated panels has slots arrayed in a lower slot bank and slots arrayed in an upper slot bank; and some of the incisions extend from a lower edge of each of the pre-fabricated panels to above the lower slot bank and some of the incisions extend from an upper edge of each of the pre-fabricated panels to below the upper slot bank.

14. The method as set forth in claim 13, further including:

said slots of said upper slot bank being adjacent to and intersecting the upper edge creating intersections with the upper edge in each of said pre-fabricated panels;

redacting the upper edge of each of the pre-fabricated panels around the intersections with the upper edge creating funnel-like apertures at the intersections with the upper edge of each of the slots of the upper slot bank.

15. The method as set forth in claim 14, further including:

aligning said slots of the lower slot bank with the slots of the upper slot bank in each pre-fabricated panel.

16. A method of constructing a container comprising:

providing a first panel having a first plurality of tabs and a first plurality of slots;

providing a second panel having a second plurality of tabs and a second plurality of slots;

determining a size of box that is required for the given job;

aligning at least a first tab and a third tab from the first plurality of tabs in the first panel in at least two correct slots of the second plurality of slots in the second panel, and aligning at least a second tab and a fourth tab from the second plurality of tabs in the second panel in at least two correct slots of the first plurality of slots in the first panel to achieve desired box size;

positioning said first, second, third and fourth tabs with respect to the correct slots;

sliding the tabs down to interlock the panels;

folding the panels;

folding lower flaps inward to create a bottom of the container;

securing the lower flaps in place;

folding upper panels inward creating a top of the container; and, securing the upper flaps in place.

* * * * *